US007770411B2

(12) United States Patent
Knight et al.

(10) Patent No.: US 7,770,411 B2
(45) Date of Patent: Aug. 10, 2010

(54) SYSTEM AND METHOD FOR USING HOT GAS REHEAT FOR HUMIDITY CONTROL

(75) Inventors: John Terry Knight, Moore, OK (US); Stephen Wayne Bellah, Oklahoma City, OK (US); Stephen Blake Pickle, Norman, OK (US)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 12/247,463

(22) Filed: Oct. 8, 2008

(65) Prior Publication Data

US 2009/0064711 A1 Mar. 12, 2009

Related U.S. Application Data

(60) Division of application No. 11/027,402, filed on Dec. 30, 2004, now Pat. No. 7,434,415, which is a continuation of application No. 10/694,316, filed on Oct. 27, 2003, now abandoned.

(60) Provisional application No. 60/425,172, filed on Nov. 8, 2002.

(51) Int. Cl.
*F25B 1/00* (2006.01)

(52) U.S. Cl. ..... 62/498

(58) Field of Classification Search ..... 62/160, 62/176.1, 324.1, 498

See application file for complete search history.

(56) References Cited

U.S. PATENT DOCUMENTS

| | | | |
|---|---|---|---|
| 2,286,605 | A | 6/1942 | Crawford |
| 3,139,735 | A | 7/1964 | Malkoff et al |
| 3,316,730 | A | 5/1967 | Lauer |
| RE26,695 | E | 10/1969 | Jensen |
| 3,779,031 | A | 12/1973 | Akiyama et al |
| 4,173,125 | A | 11/1979 | Bradshaw |
| 4,173,924 | A | 11/1979 | Bradshaw |
| 4,182,133 | A | 1/1980 | Haas et al. |

(Continued)

FOREIGN PATENT DOCUMENTS

| | | |
|---|---|---|
| WO | 9310411 | 5/1993 |
| WO | 0250623 A1 | 6/2002 |
| WO | 03054457 A1 | 7/2003 |

OTHER PUBLICATIONS

Department of the Air Force letter, Tyndall Air Force Base, Jul. 13, 1993.

(Continued)

*Primary Examiner*—Melvin Jones
(74) *Attorney, Agent, or Firm*—McNees Wallace & Nurick, LLC

(57) ABSTRACT

A humidity control method is provided for a multi-stage cooling system having two or more refrigerant circuits that balances humidity control and cooling demand. Each refrigerant circuit includes a compressor, a condenser and an evaporator. A hot gas reheat circuit having a hot gas reheat coil is connected to one of the refrigerant circuits and is placed in fluid communication with the output airflow from the evaporator of that refrigerant circuit to provide additional dehumidification to the air when humidity control is requested. The hot gas reheat circuit bypasses the condenser of the refrigerant circuit during humidity control. Humidity control is only performed during cooling operations and ventilation operations.

14 Claims, 3 Drawing Sheets

U.S. PATENT DOCUMENTS

| | | | | |
|---|---|---|---|---|
| 4,270,362 | A | 6/1981 | Lancia et al. | |
| 4,271,678 | A | 6/1981 | Leibert | |
| 4,367,631 | A | 1/1983 | Johnson et al. | |
| 4,367,787 | A | 1/1983 | Bradshaw | |
| 4,398,452 | A | 8/1983 | Bradshaw | |
| 4,432,147 | A | 2/1984 | Chen et al. | |
| 4,442,049 | A | 4/1984 | Bloomer | |
| 4,494,596 | A | 1/1985 | Bradshaw | |
| 5,065,586 | A | 11/1991 | Shapiro-Baruch | |
| 5,228,301 | A | 7/1993 | Sjoholm et al. | |
| 5,265,433 | A | 11/1993 | Beckwith | |
| 5,345,776 | A | 9/1994 | Komazaki et al. | |
| 5,390,505 | A | 2/1995 | Smith et al. | |
| 5,400,607 | A | 3/1995 | Cayce | |
| 5,400,609 | A | 3/1995 | Sjoholm et al. | |
| 5,410,889 | A | 5/1995 | Sjoholm et al. | |
| 5,752,389 | A | 5/1998 | Harper | |
| 6,055,818 | A * | 5/2000 | Valle et al. | 62/173 |
| 6,059,016 | A | 5/2000 | Rafalovich et al. | |
| 6,123,147 | A | 9/2000 | Pittman | |
| 6,131,653 | A | 10/2000 | Larsson | |
| 6,355,091 | B1 | 3/2002 | Felber et al. | |
| 6,381,970 | B1 | 5/2002 | Eber et al. | |
| 6,415,617 | B1 | 7/2002 | Seem | |
| 6,427,454 | B1 | 8/2002 | West | |
| 6,427,461 | B1 | 8/2002 | Whinery et al. | |
| 6,644,049 | B2 | 11/2003 | Alford | |
| 6,792,767 | B1 | 9/2004 | Pargeter et al. | |
| 6,826,921 | B1 * | 12/2004 | Uselton | 62/176.6 |
| 7,062,930 | B2 | 6/2006 | Rayburn | |
| 7,219,505 | B2 * | 5/2007 | Weber et al. | 62/90 |
| 7,434,415 | B2 * | 10/2008 | Knight et al. | 62/173 |
| 2004/0089015 | A1 | 5/2004 | Knight et al. | |

OTHER PUBLICATIONS

Rapid Engineering Publication, ICS II Sequence of Operation, Nov. 4, 1996.

Desert Aire Publication, Milwaukee, Wisconsin, Dehumidifier, Nov. 4, 1998.

Desert Aire Publication, Milwaukee, Wisconsin, Technical Bulletin, Jun. 1998.

Modern Refrigeration and Air Conditioning, p. 689, 1982.

Task/Ambient Conditioning Systems: Engineering and Application Guidelines, University of California, Oct. 1996.

* cited by examiner

SYSTEM AND METHOD FOR USING HOT GAS REHEAT FOR HUMIDITY CONTROL

CROSS REFERENCE TO RELATED APPLICATIONS

This application is a divisional of application Ser. No. 11/027,402, filed Dec. 30, 2004, which is incorporated by reference in its entirety and is a continuation of application Ser. No. 10/694,316, filed Oct. 27, 2003, now abandoned, which claims the benefit of U.S. Provisional Application No. 60/425,172, filed Nov. 8, 2002.

FIELD OF THE INVENTION

The present invention relates generally to a humidity control application for a cooling system. More specifically, the present invention relates to a method for performing humidity control using hot gas reheat in a two-stage cooling unit.

BACKGROUND OF THE INVENTION

Air delivery systems, such as used in commercial applications, typically are systems that can be used to cool or to accomplish dehumidification when ambient conditions are such that there is no demand for cooling. This demand for dehumidification can often occur on days when the temperature is cool and there is a high humidity level, such as damp, rainy spring and fall days. Under such conditions, it may be necessary to switch the operation of the air delivery system from cooling mode to dehumidification mode.

When switching an air delivery system, such as are used in commercial applications, from the cooling mode to the dehumidification mode in a reheat system that includes a reheat coil and a condenser coil configured in a parallel arrangement, some refrigerant will become trapped in the condenser coil. As the outdoor temperature falls, the amount of refrigerant that becomes trapped in the condenser coil will increase, resulting in a drop in the quantity of refrigeration available in the remainder of the refrigerant system to accomplish dehumidification. Without adequate refrigerant in the dehumidification circuit, operational problems will occur with the air delivery system. Some refrigerant can become trapped in a system that includes a reheat circuit even on warm days when dehumidification is required, but cooling is not required. The refrigerant can become trapped in the condenser coil, and if switching is required to the cooling mode, additional refrigerant can be trapped in the reheat circuit.

One of the problems is decreased system capacity as the refrigerant normally available in a properly operating system is trapped in the condenser coil and not available to the compressor. Associated with this problem is inadequate suction pressure at the compressor, since the gas refrigerant that normally is available to the compressor from the evaporator is trapped as a liquid in the condenser.

What is needed is an air delivery system that can remove refrigerant trapped as a liquid in the condenser, which is exacerbated in cooler, damp weather, and make the refrigerant readily available to the compressor, thereby restoring the capacity, efficiency and stability of the system and allow for the system to operate in the dehumidification mode regardless of the outdoor ambient temperature.

SUMMARY OF THE INVENTION

The present invention utilizes a hot gas reheat circuit in a standard cooling system to control temperature and humidity of an interior space in a building. The hot gas reheat circuit is connected to the high-pressure side of the compressor. In the dehumidification mode, when additional cooling is not required, the hot gas reheat circuit is activated to provide hot refrigerant gas to heat cooled air to the required temperature after the air has been dehumidified.

In order to prevent refrigerant from being trapped in the condenser thereby depleting the available refrigerant for compressor operation as refrigerant is trapped in the condenser coils when the reheat circuit is activated and the condenser is isolated from the compressor, when the hot gas reheat circuit is activated, which readily occurs on cool days, and to prevent additional refrigerant from being trapped in the reheat coils when the reheat circuit is inactivated and isolated from the compressor, the present invention incorporates a reheat by-pass circuit and a cooling by-pass circuit into the system.

The cooling refrigerant recovery circuit, when activated, is in fluid communication with the hot gas reheat circuit. It is activated when the hot gas reheat circuit is inactivated and the cooling mode is restored, in order to remove refrigerant from the reheat coil to the low-pressure side of the compressor.

The reheat by-pass circuit, when activated, is in fluid communication with the condenser. It is activated when the hot gas reheat circuit is activated and the cooling mode is inactivated, so as to remove refrigerant from the condenser to the low-pressure side of the compressor.

An advantage of the present invention is that refrigerant is not trapped in an inactive coil when switching between cooling cycles and reheat (dehumidification) cycles, thereby assuring that adequate refrigerant is available to the compressor.

Another advantage of the present invention is that comfort cooling in the interior space of a building is not compromised when there is a demand for humidity control.

Yet another advantage is that refrigerant can be quickly removed from a condenser, regardless of ambient conditions, to a location within the system where the refrigerant is available on demand to the compressor when the system is not in a cooling mode.

Still another advantage of the arrangement of the present invention is that the reheat by-pass circuit utilizes heat that otherwise would be transferred to the outdoor condenser, which is an energy savings, and the removal of trapped refrigerant from the inactive condenser or the inactive reheat coil allows the system to operate more efficiently.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
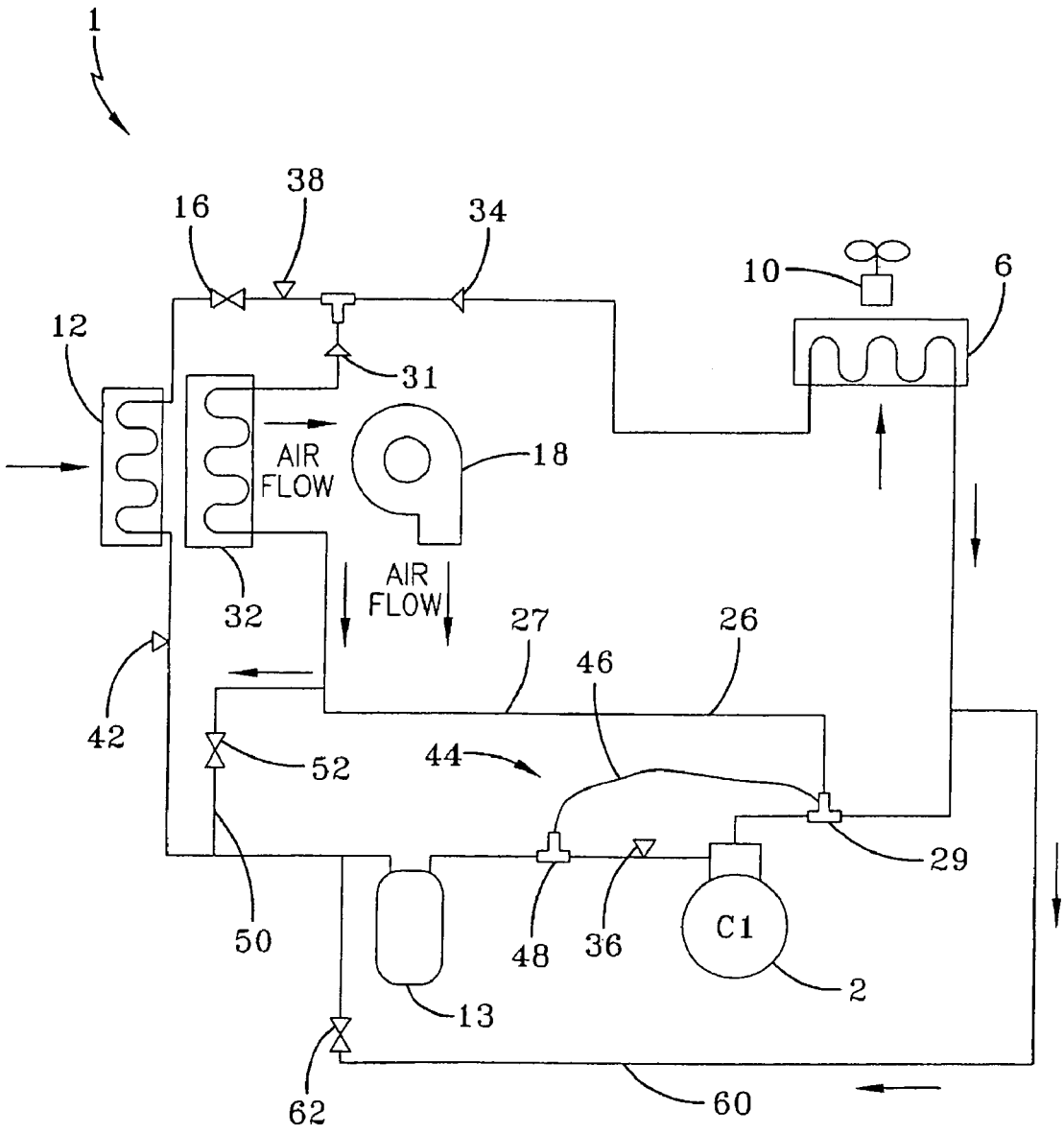
FIG. 1 illustrates schematically an embodiment of the present invention in a single compressor ventilation and air conditioning system.

FIG. 1 illustrates one embodiment of a ventilation and air conditioning (HVAC) system 1 for an interior space of a building. The HVAC system 1 provides both air conditioning control and humidity control to an interior space of a building. The HVAC system 1 typically is a single stage cooling system using compressor 2 to provide cooling capacity and humidity control in an interior space of a building which requires cooling and/or humidity control. Compressor 2 may be a any type of a compressor, such as screw compressor, a scroll compressor, a centrifugal compressor, a rotary compressor or a reciprocating compressor. In most moderate climates where cooling and humidity control is required, such as in the refrigeration section of a commercial establishment, for example a supermarket, heating is not required throughout the year. In those climates where extreme cold temperatures exist, such as for example, in the northern portions of the continental United States, Alaska and Canada, additional heating circuits can be added as will be discussed.

In operation, the system 1 includes the usual components of a cooling system, a compressor 2, connected by conduit to a condenser 6 which is connected by conduit to an evaporator 12, which is connected by conduit to compressor 2. In the cooling mode, refrigerant sealed in system 1 is compressed into a hot, high-pressure gas in compressor 2 and flows through conduit to condenser 6. The condenser 6, a heat exchanger, includes a fan 10 which blows air across the condenser coils. In the condenser, at least some of the hot, high-pressure gas refrigerant undergoes a phase change and is converted into a fluid of high-pressure refrigerant liquid or a fluid mixture of high-pressure refrigerant liquid and refrigerant vapor. In undergoing the phase change, the refrigerant transfers heat through the coils of the condenser to the air passing over the coils with the assistance of fan 10. Additional heat, heat of condensation, is given off by the refrigerant as it condenses from a gas to liquid. The high-pressure fluid passes through a conduit to an expansion device 16. As the fluid passes through expansion device 16, it expands, flashing some of the liquid to gas and ideally converting any remaining refrigerant gas to low-pressure liquid, while reducing the fluid pressure. The low-pressure fluid then passes to the evaporator 12. In evaporator 12, the refrigerant passes through the evaporator coils where the liquid refrigerant undergoes a second phase change, where the liquid refrigerant is converted to a vapor. This conversion requires energy, provided in the form of heat, which is drawn from air passing over the evaporator coils. This airflow is assisted by a fan which forces air over the coils. As shown in FIG. 1, the air is drawn over the coils by indoor blower 18. After passing over the evaporator coils, the air which is now cooler, as heat has been transferred to assist in the refrigerant phase change, can be supplied to the space that requires refrigeration. Of course, the ability of the cooled air supplied to the space to hold moisture in the form of humidity is reduced below its capacity when it passed over the evaporator coils, so the air passing into the space is also dehumidified. The excess moisture is removed from the air as condensate as it passes over the coils and is directed to a drain. The refrigerant gas, now at low-pressure and low temperature is returned to compressor 2. As shown in FIG. 1, there is an accumulator 13 which can store any excess liquid refrigerant and lubricant until a system demand calls for it. A suction line circuit 44 includes a bleed line 46. The line 46 runs from suction line 42 to valve 29 to activate or inactivate valve 29 in response to a signal from a controller (not shown).

Prior art units include a reheat circuit that runs from the high-pressure side of the compressor, across reheat coils proximate to coils of evaporator 12 similar to reheat circuit 26 shown in FIG. 1. These prior art circuits run from the high pressure side of the compressor to direct the flow of hot refrigerant through a reheat coil proximate the evaporator coils and back to the system in the high pressure side between the condenser 6 and the thermal expansion valve 16. The purpose of the reheat circuit is to provide dehumidification of the area to be serviced on days when no additional cooling is required. The reheat circuit utilizes hot refrigerant gas from the compressor discharge port to heat the cool, dehumidified air that has passed over the evaporator coils. This will prevent an undesirable high humidity condition in the area, as the air sent to the building space is dehumidified but, prevents further cooling as the air temperature is modulated by the reheat circuit. This is advantageous, for example, in the cold food sections of supermarkets to prevent condensation on the surfaces of coolers, which surfaces may include glass doors wherein condensation limits visibility. The high temperature, high-pressure fluid from the compressor travels through the reheat circuit into the reheat coils where heat is transferred to the cold dehumidified air that has passed over the evaporator to raise the air temperature. Any suitable logic controls and properly located sensors can be used to control the operation of the compressor and/or the flow of air and refrigerant fluid through the reheat circuit to provide the appropriate heat balance to maintain the temperature within predetermined limits during dehumidification. Proper sizing of the reheat coil so that the available surface area for air passing over the reheat coil can be matched with the available surface area of the evaporator coil. A wide range of varying sizes for both the reheat coil and the coils of the evaporator 12 that otherwise would not be effective together can be matched provided that logic controls can precisely control refrigerant flow, compressor operation and air flow, either individually or in combination.

The prior art reheat circuit presents a problem on humid days in which no additional cooling of the area is required but in which the reheat circuit must be activated so that proper dehumidification can be provided. When the reheat circuit is activated on such days, refrigerant is trapped in the condenser coil. On colder days, as the outdoor temperature falls, increasing amounts of refrigerant are trapped in the condenser coil, which is typically an outdoor unit located on a roof, although the outdoor unit can be located at any other convenient location. The increased refrigerant in the condenser coil results in decreased amounts of refrigerant and lubricant available in the remainder of the system, in particular, in the reheat or dehumidification circuit, which can lead to operational problems. The worst-case scenario is compressor damage due to inadequate lubrication and/or system failure due to icing of the evaporator. Less serious problems include: decreased system capacity due in part to the inability to properly dehumidify the building space and system instability due to inadequate suction pressure at the compressor as the amount of refrigerant at the compressor inlet is reduced. These problems may also occur when a cooling demand is required. In this instance, the liquid can become entrapped in the reheat coil as the reheat circuit is inactivated.

The system of the present invention, which is diagrammatically depicted in FIG. 1 includes a hot gas reheat circuit 26 that further includes a main loop 27, a reheat refrigerant recovery circuit 60 and a cooling refrigerant recovery circuit 50. Reheat refrigerant recovery circuit 60 comprises conduit that runs from the low-pressure side of compressor 2, preferably connected to the system or conduit between the evaporator 12 and a refrigerant accumulator 13, to the line between valve 29 and condenser 6, and a solenoid valve 62 to control the flow of fluid through the circuit.

Cooling refrigerant recovery circuit 50 comprises a conduit that connects the main loop 27 between hot gas reheat coil 32 and valve 29 to the low pressure side of compressor 2, preferably connected to the system or conduit running between the evaporator 12 and accumulator 13, and a solenoid valve 52 to control the flow of fluid through the circuit. Circuits 60 and 50 prevent substantial amounts of refrigerant from being trapped in the condenser 6 and hot gas reheat coil 32 respectively, as will be explained.

When the system is in the cooling mode and switches to the reheat mode, as will happen under excessively humid conditions, a controller (not shown) will send a signal to open the three-way hot gas reheat solenoid valve 29 causing gas to flow through main loop 27. In addition, the controller will send a signal to close valve 52 and open valve 62. The closing of valve 52 and opening of valve 29, which may be a two way valve, cycles hot refrigerant gas through main loop 27 to hot gas coil 32 through check valve 31 and to thermal expansion valve 16. Check valve 34 prevents hot refrigerant from flowing to condenser 6. The opening of valve 62 connects the low pressure side of the system to condenser 6, which is at a higher pressure as the system has just been switched from cooling mode to reheat mode. The pressure differential between condenser 6 and conduit on the low-pressure side of compressor 2, as well as the suction of the compressor 2 as it operates, draws high-pressure refrigerant from the condenser 6 to the low-pressure side of the compressor 2 and to the accumulator 13, as depicted by the arrow in FIG. 1, showing the flow of refrigerant from the condenser to circuit 60, where it can be utilized to ensure proper operation of the system. Valve 62 can remain open or can cycle closed after a preselected period of time, the time selected based on drawing out all or a large portion of the refrigerant. Thus, more refrigerant is available to the system to provide it with the necessary capacity.

When the system is in the reheat mode and switches to the cooling mode, as will happen on moderately cool days as the ambient temperature rises, a controller (not shown) will send a signal to close the three-way hot gas reheat solenoid valve 29, shutting off the flow of gas through main loop 27 and directing the flow of gas to condenser 6. The controller also sends a signal to accomplish the closing of valve 62, if it is not already closed, to prevent high pressure refrigerant gas from the compressor from flowing through circuit 60. The controller also sends a signal to open valve 52 in cooling by-pass circuit. The high-pressure, high temperature refrigerant gas from the compressor flows through the condenser and through check valve 34 to thermal expansion valve 16. Check valve 31 prevents the flow of refrigerant through hot gas reheat circuit 26. The opening of valve 52 connects hot gas reheat coil 32 to the low-pressure side of the system, as shown. Reheat coil 32 is still at a higher pressure than the low-pressure side to which it has just been connected, as the system has just been switched to cooling mode from dehumidification mode. The pressure differential between reheat coil 32 and conduit on the low-pressure side of compressor 2 to which it is connected via conduit as well as the suction of the compressor as it operates, draws refrigerant from the reheat coil 32 to the low-pressure side of the compressor 2 and to accumulator 13, where it can be used by the system as needed. Valve 52 can remain open or can cycle closed after a preselected period of time. The time selected is based on drawing out all or a large portion of the refrigerant from the reheat coil 32. Thus, more refrigerant is available to compressor 2 to allow it to function as required and provide the necessary cooling capacity.

Figure 2:
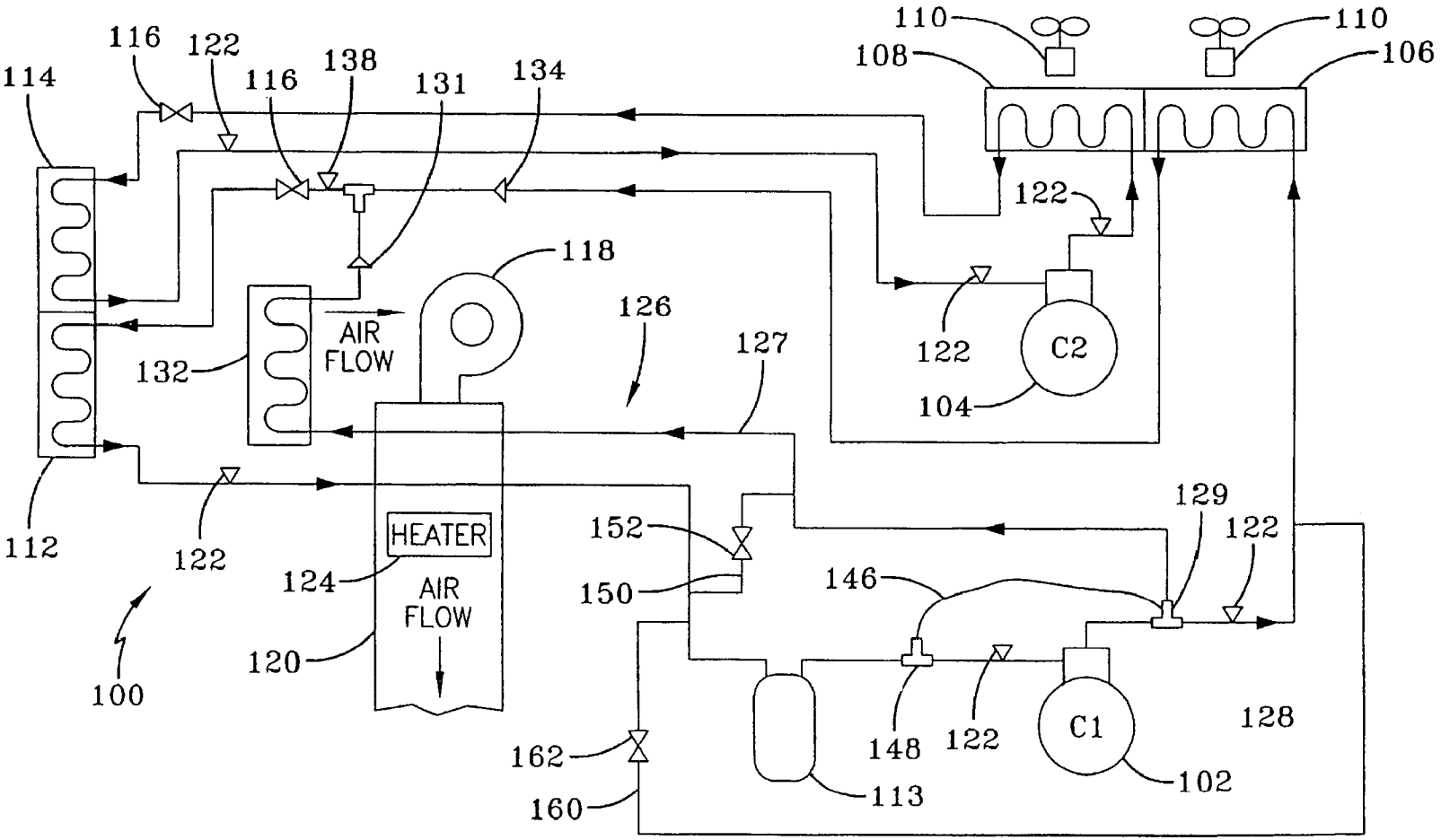
FIG. 2 illustrates schematically an embodiment of a heating, ventilation and air conditioning system for use with the present invention.

FIG. 2 illustrates one embodiment of a heating, ventilation and air conditioning (HVAC) system 100 for an interior space of a building. The HVAC system 100 can also provide humidity control to the interior space of a building. The HVAC system 100 is preferably a two stage cooling system using two compressors 102, 104 to provide two (or more) levels of cooling capacity in the interior space. Each of compressors 102, 104 can be a screw compressor, a reciprocating compressor, a rotary compressor, a scroll compressor or a centrifugal compressor. Compressors 102, 104 may have the same capacity or may be of different capacities. The two levels of cooling capacity can be obtained by operating either one of the compressors 102, 104 or both of the compressors 102, 104 depending on the cooling demand. The first level of cooling capacity is obtained by operating just one of the compressors 102, 104 during period of lower cooling demand. One of the compressor 102, 104 used to provide the first level of cooling capacity can be referred to as the primary compressor or the stage one compressor. To simplify the explanation of the present invention and to correspond to the system 100 as shown in FIG. 1, compressor 102 will be referred to as the stage one or primary compressor. It is to be understood that in another embodiment of the present invention, compressor 104 can be used as the stage one or primary compressor instead of compressor 102.

The stage one compressor 102 is preferably operated during times when the cooling demand in the interior space of the building is low. As the cooling demand in the interior space increases in response to a variety of factors such as the increasing exterior (ambient) temperature, compressor 104 is energized and will be referred to as the stage two or secondary compressor. The operation of the two compressors 102 and 104 provides the maximum amount of cooling capacity from the HVAC system 100. A control program or algorithm executed by a microprocessor or control panel in response to sensor readings is used to determine when the stage two compressor 104 is to be started in response to the higher cooling demand. The control program can receive a variety of possible inputs, such as temperature, pressure and/or flow measurements, to be used in making the determination of when to start the stage two compressor 104. It is to be understood that the particular control program and control criteria for engaging and disengaging the stage two or secondary compressor 104 can be selected and based on the particular performance requirements of the HVAC system 100 desired by a user of the HVAC system 100.

Compressors 102, 104 are each used with a separate refrigeration circuit. The compressors 102, 104 each compress a refrigerant vapor and deliver the compressed refrigerant vapor to a corresponding condenser 106, 108 by separate discharge lines. The condensers 106, 108 are separate and distinct from one another and can only receive refrigerant vapor from its corresponding compressor 102, 104. The condensers 106, 108 can be located in the same housing, and can be positioned immediately adjacent to one another, as shown in FIG. 2, or alternatively, the condensers 106, 108 can be spaced a distance apart from one another. The positioning of the condensers 106, 108 can be varied so long as the separate refrigeration circuits are maintained. The refrigerant vapor delivered to the condensers 106, 108 enters into a heat exchange relationship with a fluid, preferably air, flowing through a heat-exchanger coil in the condenser 106, 108. To assist in the passage of the fluid through the heat exchanger coils of condensers 106, 108, fans 110 can be used to draw air over the coils of the condensers 106, 108. The refrigerant vapor in the condensers 106, 108 undergoes a phase change to a refrigerant liquid as a result of the heat exchange relationship with the air flowing over the heat-exchanger coils, the air removing heat from the refrigerant. The condensed liquid refrigerant from condensers 106, 108 flows to a corresponding evaporator 112, 114 after passing through corresponding expansion valves 116. Similar to the condensers 106, 108, the evaporators 112, 114 are separate and distinct from one another and can only receive refrigerant from its corresponding condenser 106, 108. The evaporators 112, 114 can be located in the same housing, can be positioned immediately adjacent to one another or alternatively, the evaporators 112, 114 can be spaced a distance apart from one another. The positioning of the evaporators 112, 114 can be varied as desired, so long as the separate refrigeration circuits are maintained.

The evaporators 112, 114 can each include a heat-exchanger coil having a plurality of tube bundles within the evaporator 112, 114. A fluid, preferably air, travels or passes through and around the heat-exchanger coil of the evaporators 112, 114. Once the air passes through the evaporators 112, 114 it is discharged by blower 118 to the interior space via supply duct 120. The liquid refrigerant in the evaporators 112, 114 enters into a heat exchange relationship with the air passing through and over the evaporators 112, 114 to chill or lower the temperature of the air before it is provided to the interior space by the blower 118 and the supply duct 120. The refrigerant liquid in the evaporators 112, 114 undergoes a phase change to a refrigerant vapor as a result of the heat exchange relationship with the air passing through the evaporators 112, 114, the refrigerant absorbing heat from the air. In addition to cooling the air, the evaporators 112, 114 also operate to remove moisture from the air passing through the evaporators. Moisture in the air condenses on the coils of the evaporators 112, 114 as a result of the heat exchange relationship entered into with the refrigerant in the heat-exchanger coil. The vapor refrigerant in the evaporators 112, 114 then returns to the corresponding compressor 102, 104 by separate suction lines to complete the cycle.

In addition, system 100 can include one or more sensors 122 for detecting and measuring operating parameters of system 100. The signals from the sensors 122 can be provided to a microprocessor or control panel (not shown) that controls the operation of system 100. Sensors 122 can include pressure sensors, temperature sensors, flow sensors, or any other suitable type of sensor for evaluating the performance of system 100.

System 100 shown in FIG. 2 also has a heating mode and a ventilation mode. When system 100 is required to provide heating or ventilation to the interior space, the compressors 102, 104 are shut down and the air passes over the coils of evaporators 112, 114 to the blower 118 without any substantial change in temperature. The blower 118 then blows the air over a heater 124 located in the supply duct 120, with heater 124 switched off, or immediately adjacent to the supply duct 120 to heat the air to be provided to the interior space for the heating mode, or alternatively the air is provided to the interior space through the supply duct 120 for the ventilation mode. The heater 124 can be an electrical heater providing resistance heat, a combustion heater or furnace burning an appropriate fuel for heat or any other suitable type of heater or heating system.

As mentioned above, system 100 of FIG. 2 can provide humidity control to the interior space. In a preferred embodiment, the humidity control can be obtained through the use of a hot gas reheat circuit 126 that is connected to the refrigeration circuit of the first stage compressor 102. The reheat circuit operates in the same manner as the circuit set forth in FIG. 1 described above. The reheat circuit 126 includes a main loop 127 as well as a cooling refrigerant recovery circuit 150 and a reheat refrigerant recovery circuit 160, The reheat circuit 126 includes a first valve 129, which preferably is a three-way valve, positioned between the compressor 102 and the condenser 106. A second solenoid valve not shown in FIG. 2, which also may be a two-way valve positioned between the condenser 106 and the expansion valve 116. Alternatively, a pair of check valves 131, 134 may be substituted for the second solenoid valve and positioned as shown in FIG. 2, between the expansion valve 116, reheat coil 132 and condenser 106 as shown. A reheat coil 132 is in fluid communication with the first valve 129. The reheat coil is also in fluid communication with the air exiting evaporator 112 (and possibly the air exiting evaporator 114) and the air entering the blower 118, the air passing over the evaporator coils as refrigerant flows through the evaporator coils.

When system 100 is in a cooling mode, valve 129 is configured or positioned so that refrigerant flows from the compressor 102 to the condenser 106. A check valve 131 prevents flow of refrigerant from condenser 106 into reheat coil 132 in the cooling mode. In contrast, when the HVAC system 100 is in a humidity control mode, three-way hot gas reheat valve 129 is configured or positioned to permit refrigerant to flow from the compressor 102 to the reheat coil 132 and check valve 134 prevents refrigerant from flowing to condenser 106. Check valves 131 and 134 are the most economical way of controlling the flow. However, they may be replaced by a switchable two-position valve that regulates the flow of refrigerant through the appropriate circuit in response to a signal from a controller. The reheat circuit 126 is used to bypass the condenser 106, when the HVAC system 100 is in the humidity control mode. The reheat coil 132 then performs the functions of the condenser 106 when the HVAC system 100 is in humidity control mode. Reheat circuit includes a main loop 127, a cooling refrigerant recovery circuit 150 and a reheat refrigerant recovery circuit 160. Cooling refrigerant recovery circuit 150 includes a solenoid valve 152 and has the same arrangement and operation in the system as described above for cooling refrigerant recovery circuit 50 of FIG. 1. Reheat refrigerant recovery circuit 160 includes a solenoid valve 162 and has the same arrangement and operation in the system as described above for reheat refrigerant recovery circuit 60. The second compressor 104 and heater 124, however, provide system 100 with more flexibility as will become obvious.

The operation of system 100 in the humidity control mode is controlled by controller, which may be a microprocessor or control panel. The control panel receives input signals from sensor(s), such as may be found in a thermostat or humidistat, and determines whether there is a demand for cooling, heating, ventilation and/or humidity control. More specifically, the control panel can receive input signals from sensors and determine whether there is a demand for stage one cooling, stage two cooling, humidity control, heating, and ventilation. In another embodiment of the present invention, the control panel can receive input signals from sensors and determine whether a demand exists for stage one cooling and/or stage 2 cooling instead of a general signal indicating a cooling demand. The control panel then processes these input signals using the control method of the present invention and generates the appropriate control signals to the components of the HVAC system 100 to obtain the desired response to the input signals received from the sensor(s).

Figure 3:
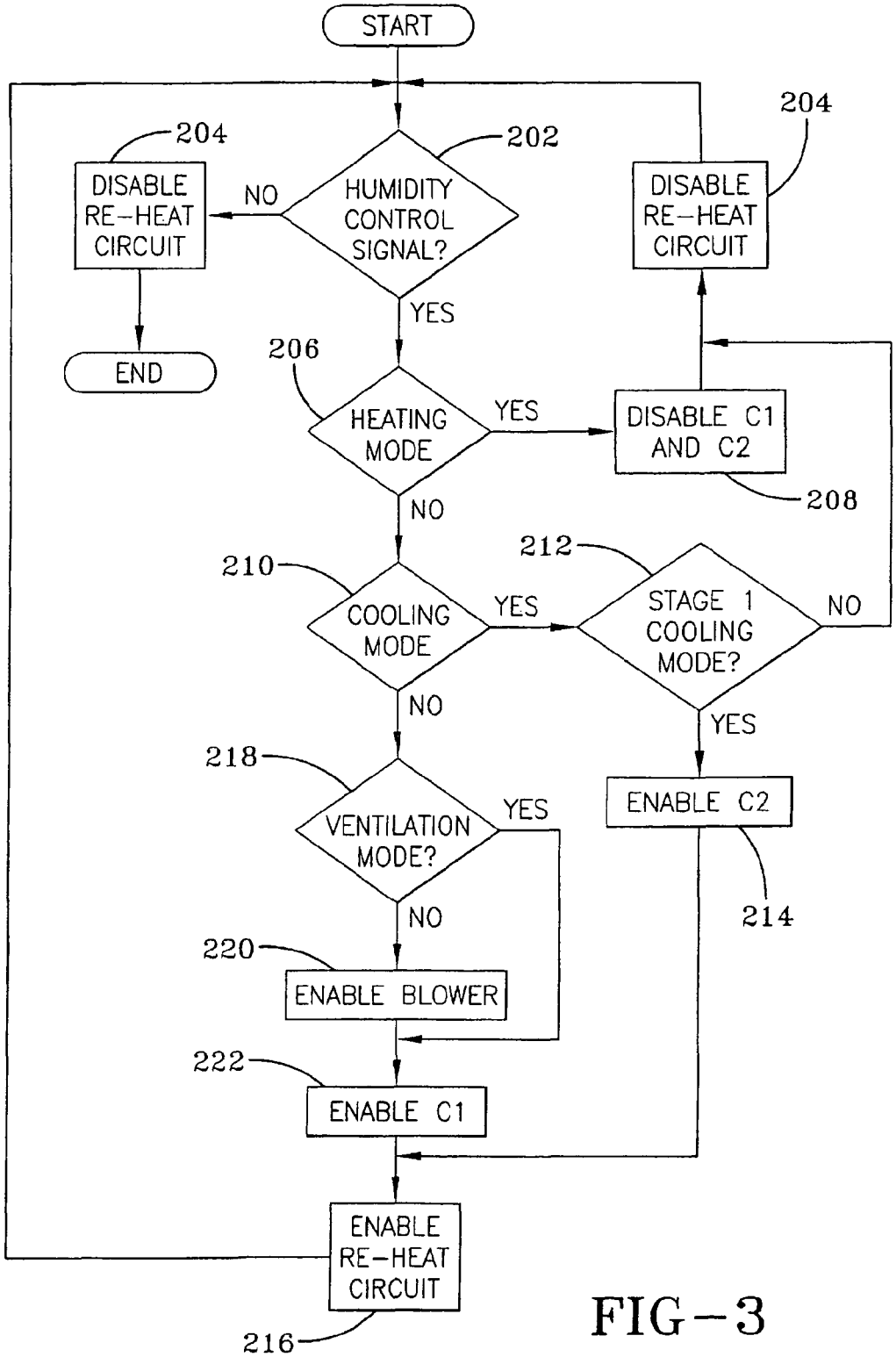
FIG. 3 illustrates a flow chart detailing the humidity control method of the present invention.

FIG. 3 illustrates a flow chart detailing the humidity control method of the present invention for a HVAC system 100 as shown in FIG. 2. The process begins with a determination of whether a humidity control signal has been received in step 202. The humidity control signal is generated by a controller in response to a signal from a sensor and determines that humidity control is required in the interior space of the building. If a humidity control signal is not received in step 202, the hot gas reheat circuit 126 is disabled, i.e. the valve 129 is positioned to prevent flow of refrigerant to the hot gas reheat coil 132, in step 204 and the process is ended. Otherwise, the process continues to step 206 to determine if the HVAC system 100 is currently in the heating mode in view of the receipt of a humidity control signal.

If the HVAC system 100 is in the heating mode in step 206, then primary and secondary compressors 102, 104 are disabled and/or shut down in step 208 and the hot gas reheat circuit 126 is disabled as described above in step 204. The process then returns to the beginning to determine if a humidity control signal is present in step 202. When the HVAC system 100 is in the heating mode, the compressors 102, 104 and the hot gas reheat circuit 126 are disabled because the heating of the air by the heater 124 provides adequate dehumidification of the air provided to the interior space of the building.

If the HVAC system is not in the heating mode in step 206, the process advances to step 210 to determine if the HVAC system 100 is in a cooling mode. If the HVAC system 100 is in a cooling mode in step 210, control advances to step 212 to determine if the HVAC system 100 is in a stage one cooling mode. As discussed above, in the stage one cooling mode there is a low cooling demand and only primary compressor 102 is operating. If the HVAC system 100 is in the stage one cooling mode, the secondary compressor 104 is enabled and/or started in step 214 and then the hot gas reheat circuit 126 is enabled in step 216 to provide humidity control to the air provided to the interior space. The hot gas reheat circuit 126 is enabled by positioning valve 129 to prevent the flow of refrigerant to condenser 106 and to permit the flow of refrigerant through the reheat coil 132 to further dehumidify the air from the evaporator 112. Reheat refrigerant recovery circuit 150 prevents refrigerant from being trapped in the condenser as described above. The starting of the secondary compressor 104 in step 214 enables evaporator 114 to provide additional cooling to the air to satisfy the cooling demand. In this mode, the HVAC system 100 can provide both cooling and dehumidification to the air to satisfy both cooling demands and humidity control demands.

If the HVAC system 100 is in a cooling mode, as determined in step 210, but not in a stage one cooling mode in step 212, then the HVAC system 100 necessarily must be in a stage two cooling mode and both primary and secondary compressors 102, 104 are in operation to provide cooling to the interior space. The hot gas reheat circuit 126 is disabled in step 204 after the determination in step 212 is negative and then proceeds to the beginning to start the process again and refrigerant is withdrawn from reheat coil 132 in circuit 150 of the present invention as described above. Humidity control using the hot gas reheat circuit 126 is not provided when the HVAC system is providing two-stage cooling. The operation of evaporators 112, 114 to cool the air provides dehumidification of the air to the interior space of the building. Once the demand for cooling is lowered or reduced, the hot gas reheat circuit 126 is enabled to provide dehumidification as discussed in greater detail above with regard to steps 212-216.

Referring back to step 210, if the HVAC system 100 is not in a cooling mode, a determination is made in step 218 to determine if the HVAC system 100 is in a ventilation mode. If the HVAC system is not in a ventilation mode in step 218, blower 118 is enabled and/or started in step 220, the primary compressor is enabled and/or started in step 222 and the hot gas reheat circuit 126 is enabled in step 216 to provide humidity control to the air for the interior space. If the HVAC system 100 is in the ventilation mode, then the primary compressor 102 is enabled and/or started in step 222 without activating blower 118 and the hot gas reheat circuit 126 is enabled in step 216 to provide humidity control to the air for the interior space.

As can be seen in the control process of FIG. 3, humidity control using the hot gas reheat circuit 126 and reheat coil 132 can be provided when the HVAC system 100 is in a stage one cooling mode or a ventilation mode. By engaging the hot gas reheat circuit 126 for humidity control in the above mentioned modes, the humidity control method of the present invention can balance the need for cooling with the need for humidity control.

In another embodiment of the present invention, the user of HVAC system 100 can view a control panel to determine the particular humidity control mode. For example, if an LED on the control panel is flashing two times in a predetermined time interval, then the HVAC system 100 is in humidity control mode without any demand for cooling. However, if the LED on the control panel is flashing three times in a predetermined time interval, then the HVAC system 100 is in a humidity control mode while there is a demand for comfort cooling. It is to be understood that the display method for the humidity control mode on the control panel can be modified as desired for the particular requirements or needs of the user to indicate the mode that the system is in. Thus, for example, an assortment of LED's can be mounted on the control panel to further indicate stage one cooling, stage two cooling, heating, ventilation etc. as desired, and the panel can be configured to user requirements or preferences.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A refrigeration circuit for use in an HVAC system comprising:

a cooling circuit having a high-pressure side and a low-pressure side, the cooling circuit comprising a compressor, a condenser and an evaporator, the cooling circuit capable of circulating refrigerant, a reheat circuit comprising a reheat coil, the reheat circuit in selective fluid communication with the cooling circuit, a first means for controlling flow of refrigerant, the first means selectively providing flow of refrigerant from the compressor to the reheat circuit or the cooling circuit, and a second means for controlling flow of refrigerant, the second means selectively providing flow of refrigerant from the reheat circuit to the cooling circuit, wherein the second means provides flow of refrigerant from the reheat circuit to the high-pressure side of the cooling circuit when the first means provides flow to the reheat circuit, and the second means providing flow of refrigerant from the reheat circuit to the low-pressure-side of the cooling circuit when the first means does not provide flow to the reheat circuit.

2. The refrigeration circuit of claim 1, wherein:

the first means is in fluid communication with the high-pressure side of the cooling circuit and is switchable between a first position in which the refrigerant from the high pressure side of the cooling circuit flows through the reheat circuit and a second position in which the refrigerant is blocked from entering the reheat circuit;

the second means being configurable to a first position in which refrigerant flows from the reheat circuit to the high-pressure side of the cooling circuit and a second position in which the refrigerant flows from the reheat circuit to the low-pressure side of the cooling circuit;

a reheat coil configured and disposed to receive refrigerant from the first means and to provide refrigerant to the second means, the reheat coil being configured to exchange heat from the refrigerant flowing through the coil from the first means to air flowing across the coil, the reheat coil in fluid communication with the evaporator in the cooling circuit so as to provide refrigerant to the evaporator when the first means for controlling is in the first position; and wherein refrigerant flows from the reheat coil to the low-pressure side of the cooling circuit in response to the first means being in the second position and the second means being in the second position.

3. The refrigeration circuit of claim 2, wherein:

the compressor includes a high-pressure discharge end and a low-pressure suction end, the first means is a first valve arrangement, the first valve arrangement configured and disposed to provide flow of refrigerant to the reheat circuit in a first position and block flow of refrigerant to the reheat circuit in a second position, and the second means is a second valve arrangement, the second valve arrangement configured and disposed to selectively provide flow of refrigerant from the reheat circuit, the second valve arrangement flowing refrigerant from the reheat circuit to the evaporator when the first valve arrangement is in the first position, and the second valve arrangement flowing refrigerant from the reheat circuit to the suction end of the compressor when the first valve arrangement is in the second position.

4. The refrigeration circuit of claim 3, wherein refrigerant flowing from the reheat circuit when the first valve arrangement is in the second position is refrigerant remaining in the reheat circuit when the first valve arrangement blocks flow to the reheat circuit.

5. The refrigeration circuit of claim 3, wherein the first valve arrangement includes one or more solenoid valves.

6. The refrigeration circuit of claim 3, wherein the second valve arrangement includes one or more solenoid valves.

7. The refrigeration circuit of claim 1, wherein the reheat coil is positioned adjacent to the evaporator wherein cooled, dehumidified air flowing across the evaporator is heated prior to entering an interior space.

8. A system comprising:

a compressor, a condenser, an expansion device and an evaporator connected by a first circuit capable of circulating a refrigerant, the first circuit comprising a first portion connecting the compressor, the condenser and the expansion device and a second portion connecting the expansion device, the evaporator and the compressor;

a second circuit comprising a heat exchanger, the second circuit being in selective fluid communication with the first circuit;

a first apparatus being configured and positioned to selectively permit refrigerant flow from the compressor to either the first circuit or the second circuit;

a second apparatus being configured and positioned to selectively permit refrigerant flow from the second circuit to the first circuit; and the second apparatus being configured to permit refrigerant flow from the second circuit to the first portion of the first circuit upon the first apparatus permitting refrigerant flow to the second circuit, and the second apparatus being configured to permit refrigerant flow from the second circuit to the second portion of the first circuit upon the first apparatus preventing refrigerant flow to the second circuit.

9. The system of claim 8 wherein:

the first apparatus is in fluid communication with the first portion of the first circuit and is switchable between a first position in which the refrigerant from the first portion of the first circuit flows through the second circuit and a second position in which the refrigerant from the first portion of the first circuit is blocked from entering the second circuit;

the second apparatus being switchable between a first position in which refrigerant flows from the second circuit to the first portion of the first circuit and a second position in which the refrigerant flows from the second circuit to the second portion of the first circuit;

a heat exchanger being positioned in the second circuit to receive refrigerant from the first apparatus and to provide refrigerant to the second apparatus;

wherein refrigerant flows from the heat exchanger to the first portion of the first circuit in response to the first apparatus being in the first position and the second apparatus being in the first position; and wherein refrigerant flows from the heat exchanger to the second portion of the first circuit in response to the first apparatus being in the second position and the second apparatus being in the second position.

10. The system of claim 9 wherein:

the compressor comprises an inlet and an outlet;

the first apparatus comprises a first valve arrangement, the first valve arrangement having a first position configured and positioned to permit refrigerant flow to the second circuit and a second position to block refrigerant flow to the second circuit;

the second apparatus comprises a second valve arrangement, the second valve arrangement configured and positioned to selectively permit refrigerant flow from the second circuit;

the second valve arrangement permitting refrigerant flow from the second circuit to the first portion of the first circuit when the first valve arrangement is in the first position; and the second valve arrangement permitting refrigerant flow from the second circuit to the inlet of the compressor when the first valve arrangement is in the second position.

11. The system of claim 10 wherein the refrigerant flowing from the second circuit when the first valve arrangement is in the second position is refrigerant remaining in the second circuit when the first valve arrangement blocks flow to the second circuit.

12. The system of claim 10 wherein the first valve arrangement includes one or more solenoid valves.

13. The system of claim 10 wherein the second valve arrangement includes one or more solenoid valves.

14. The system of claim 8 wherein the heat exchanger is positioned near the evaporator and wherein cooled, dehumidified air from the evaporator is heated by the heat exchanger prior to entering an interior space.

* * * * *